US007287362B1

(12) United States Patent
Ford

(10) Patent No.: US 7,287,362 B1
(45) Date of Patent: Oct. 30, 2007

(54) SHOCK-ABSORBING BUSHING FOR STIRRUP

(75) Inventor: Garrett N. Ford, Tucson, AZ (US)

(73) Assignee: EasyCare, Inc., Tuscon, AZ (US)

( * ) Notice: Subject to any disclaimer, the term of this patent is extended or adjusted under 35 U.S.C. 154(b) by 575 days.

(21) Appl. No.: 10/743,570

(22) Filed: Dec. 22, 2003

(51) Int. Cl.
*B68C 3/00* (2006.01)

(52) U.S. Cl. ..... 54/47

(58) Field of Classification Search ..... 54/47, 54/49, 49.5, 48, 7–9; 16/2.1, 2.5
See application file for complete search history.

(56) References Cited

U.S. PATENT DOCUMENTS

| | | | | | |
|---|---|---|---|---|---|
| 33,930 | A | * | 12/1861 | Eagle | 54/47 |
| 37,158 | A | * | 12/1862 | Eagle | 54/47 |
| 368,776 | A | * | 8/1887 | Manning | 54/8 |
| 578,956 | A | * | 3/1897 | Vann | 54/48 |
| 1,738,037 | A | * | 12/1929 | Collins | 384/296 |
| 2,647,942 | A | * | 8/1953 | Borden et al. | 174/153 G |
| 2,668,316 | A | * | 2/1954 | Sturtevant et al. | 16/2.2 |
| 3,515,417 | A | * | 6/1970 | Bowman | 403/366 |
| 4,936,081 | A | | 6/1990 | Jones | |
| 5,301,635 | A | * | 4/1994 | Rovira Badia et al. | 119/72.5 |
| 5,709,070 | A | * | 1/1998 | Peters | 54/47 |
| 5,975,022 | A | * | 11/1999 | Miller | 119/264 |
| 6,220,004 | B1 | * | 4/2001 | Hsi-Chang | 54/48 |
| 6,380,489 | B1 | * | 4/2002 | Gretz | 174/152 R |
| 6,449,930 | B2 | * | 9/2002 | Robart et al. | 54/8 |
| 6,786,180 | B1 | * | 9/2004 | Cheng | 119/72.5 |

FOREIGN PATENT DOCUMENTS

| | | | |
|---|---|---|---|
| GB | 1458742 | * | 3/1974 |
| GB | 2364558 A | * | 1/2002 |

OTHER PUBLICATIONS (Webster's) Merriam-Webster's Collegiate Dictionary 154 (10th ed. 1998).*

* cited by examiner

*Primary Examiner*—Son T. Nguyen
(74) *Attorney, Agent, or Firm*—Quarles & Brady LLP

(57) ABSTRACT

A stirrup bushing is provided with a star-shaped cross-sectional configuration that allows structural distortion when compressed by the forces exerted by a rider. The bushing consists of an inner sleeve adapted to fit tightly around the rod of the stirrup and of outer fins extending radially along the length of the inner sleeve. In an alternative, preferred embodiment, the bushing also includes an outer sleeve enveloping the longitudinal fins, so as to provide an additional structure and an expanded surface to distribute and attenuate the forces exerted by the supporting strap over the rod of the stirrup. The invention lies in the idea of providing voids in the structure of the bushing, such that compressive forces are relieved through deformation, rather than contained in a fixed geometry that produces deterioration of the material.

9 Claims, 4 Drawing Sheets

SHOCK-ABSORBING BUSHING FOR STIRRUP

BACKGROUND OF THE INVENTION

1. Field of the Invention

The invention relates to an improved shock-absorbing bushing for a stirrup.

2. Description of the Prior Art

A stirrup consists of a pair of curved arms which serve as a carrier for a footrest. Each arm is joined to the other at the top end for engagement with a supporting saddle strap threaded through an eye or other connecting structure, while the bottom ends of the arms are spaced from one another and connected to a footrest to form a substantially U-shaped structure. The foot of the rider is disposed on the footrest between the spaced ends of the arms.

In a stirrup design that has been in use for several years, illustrated in FIG. 1, the arms 10 are connected at the top by means of a rigid cross member, such as a rod or bolt 12, that securely ties the arms together and provides an anchor for attachment to the saddle strap. A tubular sleeve 14, which may be made of rigid or resilient material, is used to provide a buffering structure between the rigid cross member and the strap folded around it. If resilient, the sleeve 14 also provides shock absorption. A shock-absorbing pad 16 is typically also used on top of the footrest 18.

As illustrated in the sectioned view of FIG. 2, the sleeve 14 may be assembled tightly around the rod 12, so that the forces exerted by the weight of a rider against a supporting strap 20 may be distributed over a relatively large portion of the contact area between the rod and the sleeve. In an alternative embodiment illustrated generally in FIG. 3, the sleeve 14 is provided with a larger opening than the diameter of the rod 12, thereby reducing the contact area between the two structures.

In both types of connection, the sleeve 14 surprisingly tends to wear out relatively rapidly. In the case of the tight rod/sleeve combination of FIG. 2, the compressive forces acting on the lower half of the sleeve, illustrated by arrows F in FIG. 4, cause the deterioration of the material and the subsequent loosening of the parts, which further contributes to a continuing deterioration and loss of performance. Similarly, the compressive forces acting on the embodiment of FIG. 3 produce a deformation in the sleeve 14 that soon prevents its rotation and the corresponding distribution of wear and tear around the whole body of the sleeve, as illustrated in FIG. 5, thereby also contributing to the rapid deterioration of the sleeve.

Therefore, there is a need for a better rod/sleeve type of connection for the class of stirrups illustrated in FIG. 1. This invention is directed at such an improvement.

SUMMARY OF THE INVENTION

According to the invention, a bushing is provided with a star-shaped cross-sectional configuration that allows structural distortion when compressed by the forces exerted by a rider between the rod in the stirrup and the strap supporting it. The bushing consists of an inner sleeve adapted to fit tightly around the rod of the stirrup and of outer fins extending radially along the length of the inner sleeve. Because such configuration includes voids between the fins, the bushing's structure is allowed to freely flex and bend under pressure, which prevents the material deterioration experienced with prior-art sleeves as a result of compressive forces.

In an alternative, preferred embodiment, the bushing of the invention also includes an outer sleeve enveloping the longitudinal fins, so as to provide an additional structure and an expanded surface to distribute and attenuate the forces exerted by the strap over the fins and the rod of the stirrup. In both embodiments, the invention lies in the idea of providing voids in the structure of the bushing, such that the compressive forces are relieved through deformation, rather than contained in a fixed geometry that produces deteriorating stresses on the material.

Additional features and advantages of the invention will become clear from the following detailed description of preferred embodiments when read in conjunction with the accompanying drawings and claims.

DESCRIPTION OF THE PREFERRED EMBODIMENTS

The heart of the invention is in a bushing structure that includes sufficient voids to permit the elastic deformation of the bushing material under pressure so as to avoid the destructive effects produced when a material is compressed beyond its resilient capacity to absorb the pressure. For the purposes of this disclosure, the term "flexible" is used to refer to a material that is capable of flexing and bending in elastic fashion but that is substantially not compressible. The term "compressible" is used to refer to a material that can be reduced to a materially smaller volume by the action of pressure exerted over the material.

Figure 6:
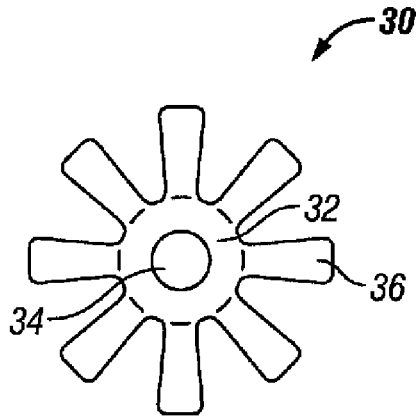
FIG. 6 is a cross-sectional view of a bushing according to the invention.
Figure 7:
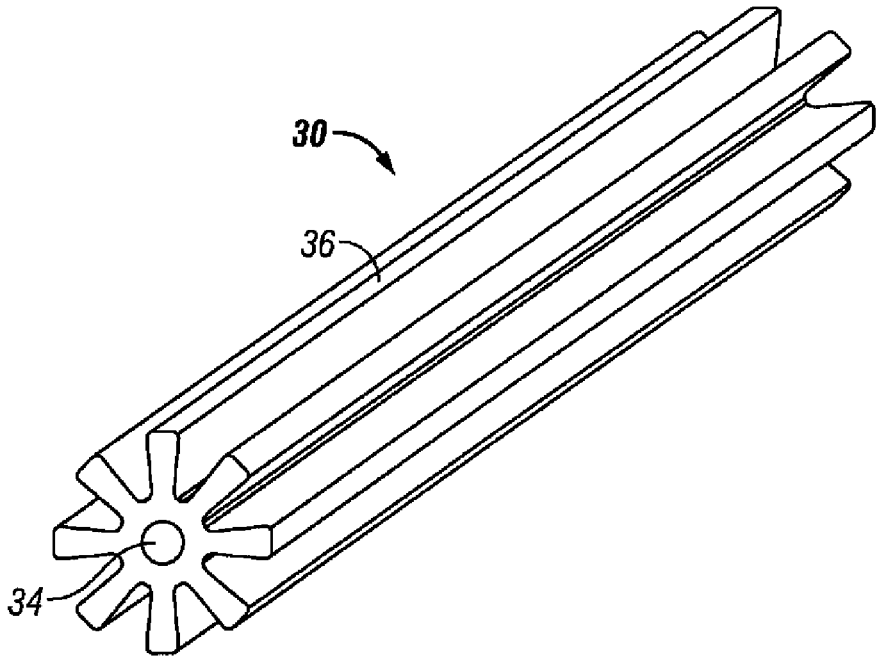
FIG. 7 is a perspective view of the bushing of FIG. 6.

Referring to the figures, wherein like parts are illustrated throughout with the same symbols and reference numerals, FIG. 6 is an elevational side view of a bushing 30 according to the invention. The bushing consists of an inner sleeve 32 (defined by an outer phantom line for purposes of illustration) that includes a longitudinal perforation 34 adapted for snug coupling with the rod 12 connecting the tops of the two arms 10 of a stirrup. The bushing 30 also includes a plurality of longitudinal fins 36 (or equivalent structures) that extend radially in substantially uniform distribution from the inner sleeve 32. The sleeve 32 and fins 36 preferably constitute a unitary structure made of a sturdy but flexible material, such as polyurethane, having a hardness measurable in the 60-90 range on the D scale of a durometer. It is anticipated that an appropriately hard rubber could also be used. FIG. 7 illustrates the bushing 30 in perspective view.

Figure 1:
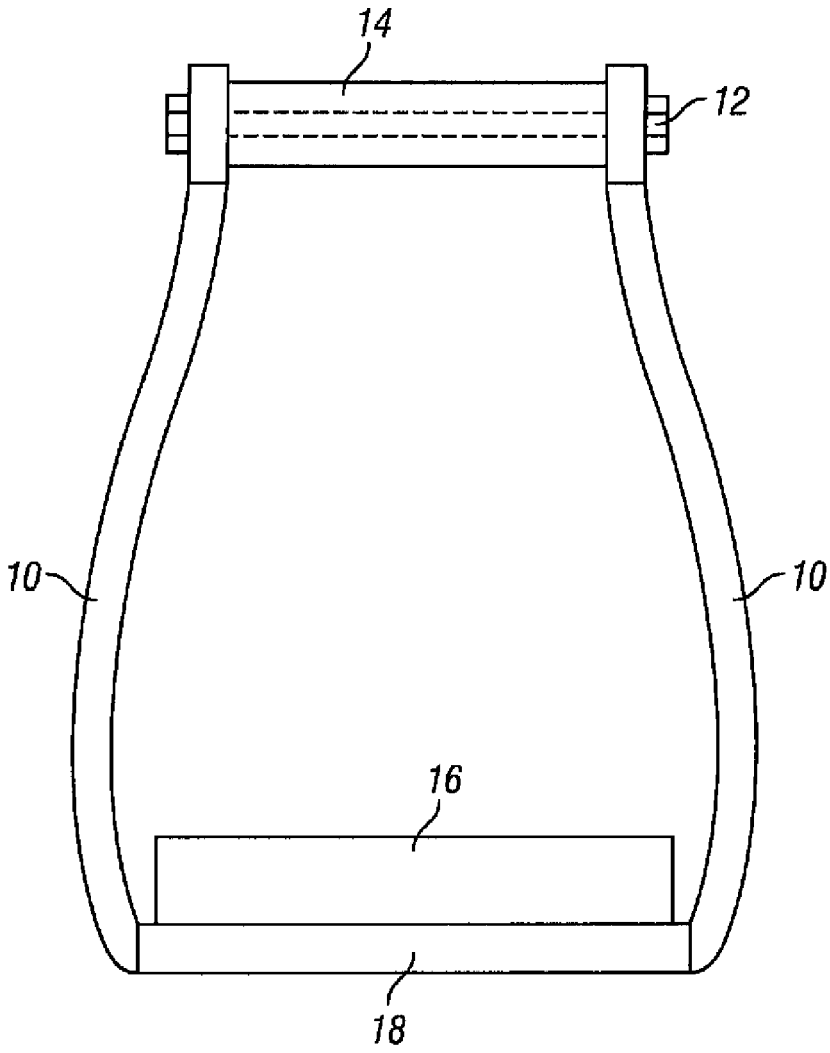
FIG. 1 (Prior Art)
FIG. 1 is an elevational view of a prior-art stirrup with a conventional bushing for attachment to a supporting strap.
Figure 2:
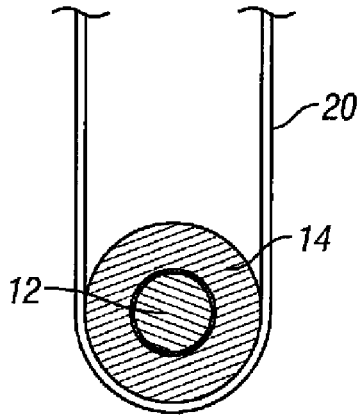
FIG. 2 (Prior Art)
FIG. 2 is a sectional view of a bushing/rod combination typically used in the stirrup of FIG. 1.
Figure 3:
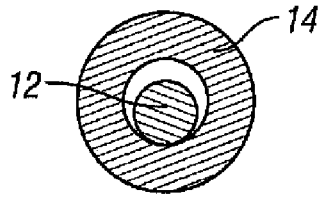
FIG. 3 (Prior Art)
FIG. 3 is a sectional view of another bushing/rod combination typically used with the stirrup of FIG. 1.
Figure 4:
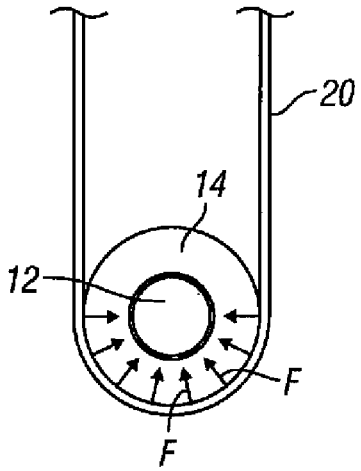
FIG. 4 (Prior Art)
FIG. 4 is a schematic elevational view illustrating the action of compressive forces over the bushing of FIG. 2.
Figure 5:
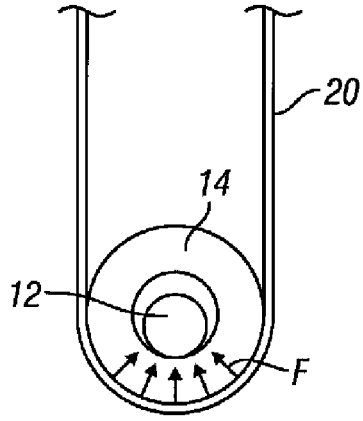
FIG. 5 (Prior Art)
FIG. 5 is a schematic elevational view illustrating the action of compressive forces over the bushing of FIG. 3.
Figure 8:
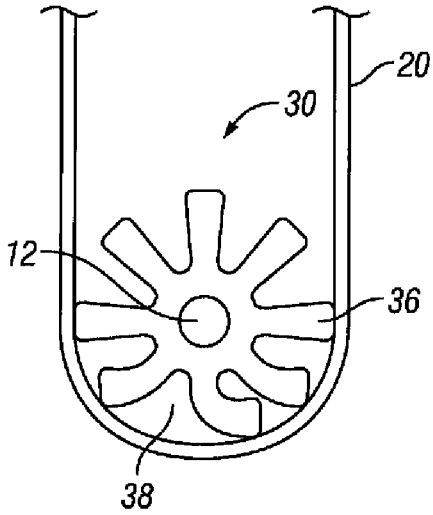
FIG. 8 is a schematic section view of the bushing of FIG. 6 illustrating the action of compressive forces produced during use.

When the bushing 30 is mounted on a bolt 12 in a stirrup of the type illustrated in FIG. 1 and is subjected to compressive forces by a strap 20, as shown in the schematic section view of FIG. 8, the fins 36 are able to flex and become deformed by occupying the void spaces 38 between the fins. As a result of this deformation, most of the energy transferred by the exertion of the compressive forces is absorbed by the process of deformation, rather then compression of the bushing material. Therefore, the bushing is not subjected to the degree of material deterioration that characterizes the annular-sleeve bushings of the prior art.

Figure 9:
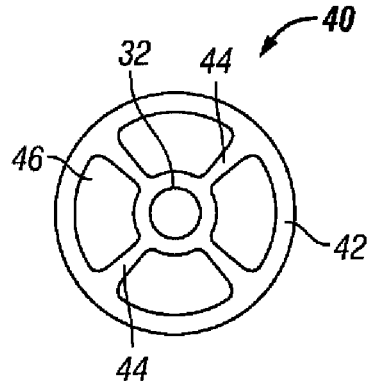
FIG. 9 is a side elevational view of another bushing according to the invention.
Figure 10:
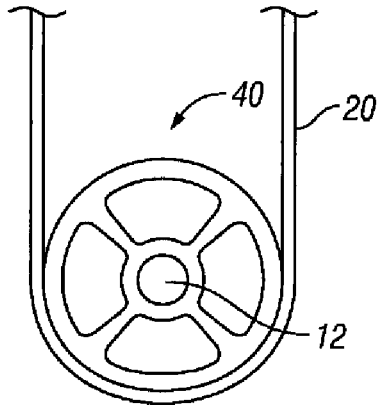
FIG. 10 is a schematic section view of the bushing of FIG. 9 illustrating the action of compressive forces produced during use.

In the preferred embodiment, the bushing 40 of the invention includes also an outer sleeve 42 substantially concentric with the inner sleeve 32, as shown in the side view of FIG. 9. The outer sleeve 42 is attached to the inner sleeve 32 by means of ribs 44 that are structurally and functionally equivalent to the fins 36 of the first embodiment. The two sleeves 32, 42 and the ribs 44 define longitudinal cavities 46 that permit the outer sleeve 42 and the ribs 44 to flex and absorb compressive forces as indicated above. The bushing 40 is also preferably made in an integral unitary structure of polyurethane. In use, the bushing 40 tends to deform as illustrated in FIG. 10.

Thus, a novel configuration has been described for a stirrup bushing that is much less susceptible to wear than the annular-sleeve bushings heretofore utilized in the art. Tests with a polyurethane bushing 40 as illustrated in FIG. 9 have shown negligible wear and tear in comparison with conventional bushings made of the same material. The fact that the new design allows flexible deformation as a result of the longitudinal void spaces between ribs is believed to be the reason for the improvement. The deformation reduces the rotational forces acting on the rod 12 of the stirrup, thereby also reducing frictional wear and failure of the inner sleeve 32 as a result of its interaction with the rod. In addition, to the extent that the bushing flexes, it also provides shock absorption for a smoother ride.

Various modifications are possible within the meaning and range of equivalence of the appended claims. Therefore, while the invention has been shown and described in what is believed to be the most practical and preferred embodiments, it is recognized that departures can be made therefrom within the scope of the invention, which is not to be limited to the details disclosed herein but is to be accorded the full scope embraced by any and all equivalent apparatus.

I claim:

1. A stirrup comprising:

a carrier;

a holding member on said carrier for holding a strap;

a footrest joined to said carrier; and a bushing mounted on said holding member;

wherein the bushing includes an inner sleeve adapted for snug connection with the holding member, longitudinal fires extending radially from the inner sleeve, and an outer sleeve connected to said fins.

2. The stirrup of claim 1, wherein said inner sleeve, outer sleeve, and fins are an integral unitary structure.

3. The stirrup of claim 1, wherein said bushing is made of polyurethane.

4. The stirrup of claim 1, wherein said inner sleeve, outer sleeve, and fins are an integral unitary structure made of polyurethane.

5. A bushing for a stirrup holding member comprising:

an inner sleeve adapted for snug connection with the holding member;

an outer sleeve substantially concentric with the inner sleeve; and a plurality of longitudinal ribs connecting the inner and outer sleeves.

6. The bushing of claim 5, wherein said inner sleeve, ribs and outer sleeve are an integral unitary structure.

7. The bushing of claim 5, wherein said bushing is made of polyurethane.

8. The bushing of claim 5, wherein said inner sleeve, fins and outer sleeve are an integral unitary structure made of polyurethane.

9. The bushing of claim 5, wherein said plurality of longitudinal ribs connecting the inner and outer sleeves consists of four ribs.

* * * * *

UNITED STATES PATENT AND TRADEMARK OFFICE

CERTIFICATE OF CORRECTION

PATENT NO. : 7,287,362 B1
APPLICATION NO. : 10/743570
DATED : October 30, 2007
INVENTOR(S) : Garrett N. Ford It is certified that error appears in the above-identified patent and that said Letters Patent is hereby corrected as shown below:

IN THE CLAIMS: Col. 4, line 14:

Claim 1, line 8, delete "fires" and insert -- fins --.

Signed and Sealed this

Twenty-fifth Day of December, 2007

JON W. DUDAS
*Director of the United States Patent and Trademark Office*